US006272698B1

(12) United States Patent
Stafford

(10) Patent No.: US 6,272,698 B1
(45) Date of Patent: Aug. 14, 2001

(54) ADJUSTABLE BATHTUB INSERT

(76) Inventor: Donald D. Stafford, 6468 Springdale Rd., Cincinnati, OH (US) 45247

( * ) Notice: Subject to any disclaimer, the term of this patent is extended or adjusted under 35 U.S.C. 154(b) by 0 days.

(21) Appl. No.: 09/733,292

(22) Filed: Dec. 11, 2000

(51) Int. Cl.[7] ..... A47K 3/02
(52) U.S. Cl. ..... 4/555; 4/584
(58) Field of Search ..... 4/555, 584, 538

(56) References Cited

U.S. PATENT DOCUMENTS 4,561,160 * 12/1985 Nicol et al. ..... 4/555 X
5,628,851 * 5/1997 Lawler ..... 4/555 X
6,061,846 * 5/2000 Peterson ..... 4/555
6,212,704 * 4/2001 Peterson ..... 4/555

* cited by examiner

*Primary Examiner*—Charles E. Phillips
(74) *Attorney, Agent, or Firm*—Neal O. Willmann

(57) ABSTRACT

This disclosure relates generally to a method and means for modifying an existing bathtub to facilitate access by creating a generally U-shaped opening in an external sidewall of the tub and positioning in said opening a generally U-shaped insert having a step saddle with an elongated step-plate and a pair of generally parallel end plates extending from the ends of the step-plate; and a pair of a generally rectangular housings attached to the bottom of the step-plate and extending to rest directly on the floor, thus supporting said step saddle.

2 Claims, 1 Drawing Sheet

ADJUSTABLE BATHTUB INSERT

BACKGROUND OF THE INVENTION

The invention disclosed herein relates generally to an insert to be placed in a cut-out section of an exposed wall of a bathtub. This insert, when properly positioned in the cutout section of the tub wall, will effectively lower the tub wall to permit easy access to the interior of the tub for those who are physically challenged by the height of the wall of the typical bathtub.

DESCRIPTION OF THE PRIOR ART

The idea of placing an insert in the wall of a bathtub is not entirely original. The bathtub remodeling industry has at least one other product. It is known as the Bathcrest insert and is fairly represented in U.S. Pat. No. 6,061,846, issued May 16, 2000 to Peterson. This insert, generically characterized as a bathtub walk-through insert is designed to be positioned and bonded into an opening cut from the exposed sidewall of a bathtub. The Bathcrest insert is generally U-shaped with a web that will rest on the bottom of the opening cut into the side of the tub.

SUMMARY OF THE INVENTION

Notwithstanding the benefits and advantages afforded by the insert of the prior art, there are design and structural modifications and improvements that need to be made in the product of the prior art to improve its function and facilitate its installation. Those modifications and improvements are embodied in the insert described herein. Specifically, what is disclosed and claimed in this specification is a bathtub sidewall insert for facilitating access to the interior of said tub wherein said insert comprises: a generally U-shaped step-saddle having an elongated step-plate; a pair of generally parallel end plates extending upwardly from the ends of said step-plate; and a pair of generally rectangular housings attached to the bottom of said step-plate for extending to the floor to distribute the weight of said step saddle and the weight of anyone using it, onto the bathroom floor. This disclosure also relates to the method of modifying an existing bathtub to facilitate access to the interior of said tub by creating an opening by cutting through an external sidewall of the bathtub, said opening extending for a predetermined length of said sidewall and from the top of said sidewall to a predetermined distance above the bottom of said bathtub, said opening being generally U-shaped; positioning in said opening a generally U-shaped insert having a step saddle with an elongated step-plate to cover the bottom edge of said opening, a pair of generally parallel end plates extending from the ends of said step-plate to cover the sides of said opening and a pair of generally rectangular housings attached to the bottom of said step-plate and extending to rest directly on the floor to support the weight of the step saddle and the weight of anyone standing, sitting or stepping on it.

DESCRIPTION OF THE PREFERRED EMBODIMENTS

Figure 1:
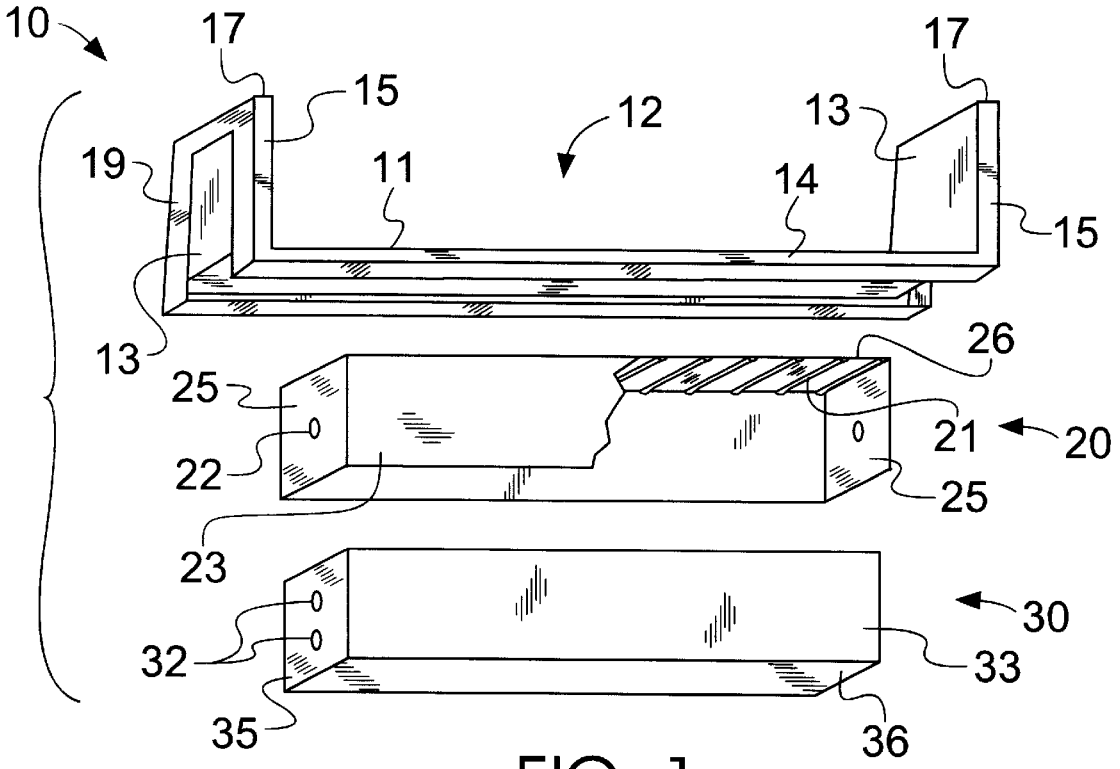
FIG. 1 is a assembly view of the disclosed bathtub insert showing its essential elements.
Figure 2:
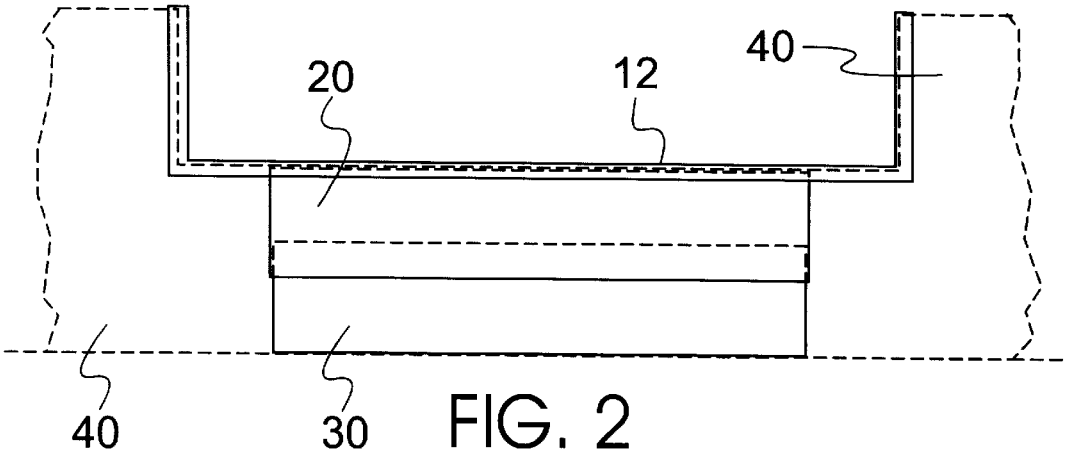
FIG. 2 is an elevated front view of the assembly positioned within a cutout in the side wall of a bathtub showing the adjustable housing supports under the step-plate.
Figure 3:
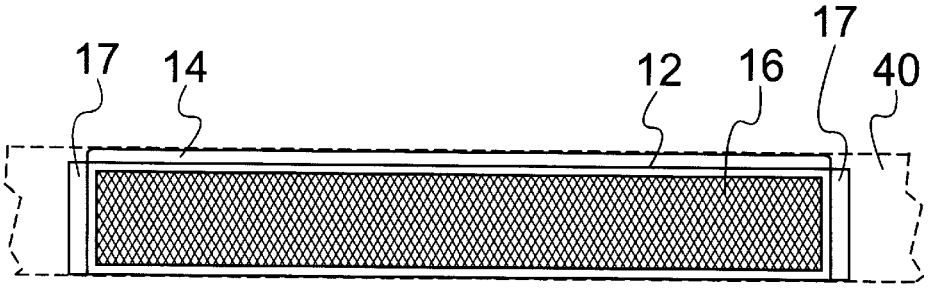
FIG. 3 is top plan view of the disclosed step-saddle, positioned within the cutout in the sidewall of a bathtub as depicted in FIG. 2, with its skid resistant surface readily apparent.

A full appreciation of the disclosed insert can be gained by referring to the drawing. FIG. 1 presents an exploded or assembly view of the disclosed insert 10. In this preferred embodiment of the disclosed insert 10, there are what could be characterized as three components of the insert. The most prominent portion is the step saddle 12, which essentially creates the step-through in the side-wall of the tub 40.

The step-saddle 12 features an elongated step-plate 11, which can be stepped over or upon to gain access to the interior of the tub 40 and a pair of step-plate flanges 14 running the length of the step-plate 11 to mate with and dress the elongated edges of the opening cut in the sidewall of the tub. The step saddle 12 also features a pair of end plates 13 each originating at the ends of the step-plate 11 and extending upward from and perpendicular to the step-plate 11 and generally parallel to each other. The end plates 13 define the ends of the step-saddle insert 10 and cover the sides of the U-shaped opening cut in the side-wall of the tub. To facilitate fitting the step saddle 12 within the opening created in the tub side-wall, each end plate 13 is preferably fitted with a top flange 17, a pair of end plate flanges 15 and return lips 19. The foregoing elements 17,15 and 19 are structural features designed to improve the fit and finished appearance of the installed insert 10.

Affixed to, and perhaps even an integral part of, the step saddle 12 is an adjustable housing 20 which is typically a rectangular box-like structure extending from the bottom or underside of the step-plate 11 and extending through the elongated bottom opening cut in the tub 40 for the placement of the insert and resting on the bathroom floor. It is this housing 20, in conjunction with support-housing 30, that provides the improved strength and adjustability afforded by the instantly disclosed insert 10. Other inserts, most notably those of the prior art, supra, rest on the edges of the opening cut in the tub side-wall. Installing an insert in this manner, without resting it on a support, other than the edges of the tub, provides an insert that is structurally deficient. Such an insert can support little more than its own weight. Notably, tub and shower users need to be forewarned against stepping, standing or sitting on the step-plate.

By way of contrast, instructions for using the disclosed unit, far from warning against or discouraging stepping on it, encourage the placement of weight by providing a non-slip tread 16 on the anterior side of the step-plate 11. And, to justify encouraging the placing of weight on the step saddle 12 of the insert 10, the housings 20 and 30, of the disclosed insert are positioned to transfer the weight of the step saddle 12, and the weight of anyone choosing to step, stand or sit on the step-plate 11, to the bathroom floor upon which the tub also rests.

In a preferred embodiment, the adjustable housing 20 is a five-sided rectangular box-like structure. Its top panel 26 will mate with or adhere to the bottom of the step-plate 11. For added support, the top panel 26 will include transverse ribs 21 incorporated or molded into the panel 26. These will aid in distributing any load or weight generally attributed to the bather. The adjustable housing 20 will also have two side panels 23 and two end panels 25. There is no bottom panel. In the end panels 25, there are exhaust ports 22 for the escape of air when the adjustable housing 20 is used in conjunction with the support-housing 30. So, ideally, the adjustable housing 20 will fit over and enclose, with a snug friction fit, and be ultimately sealed in place to support-housing 30 with the bonding power of a strong sealant, of which there are several commercially available. Air, temporarily entrapped in the adjustable housing will escape through the exhaust ports 22.

The support-housing 30 will typically be a rectangular box-like structure, not unlike the adjustable housing 20. In most instances it will feature a pair of side panels 33, a pair of end panels 35 and a bottom panel 36. The bottom panel 36 is especially useful for attaching the support-housing 30 to the bathroom floor. Typically an elastomeric sealant is all that is necessary to fix the support-housing 30 in place, but metal fasteners such as nails, staples or brads can also be used. Additional ports 32 for the escape of air compressed by the nesting of the support-housing 30 within the adjustable housing 20 can be provided in the end panels 35.

The installation of the disclosed insert 10 will proceed generally as follows: An opening, generally U-shaped, is cut in the sidewall of the bathtub. Typically, the tub is of the built-in variety of bathtub and not the porcelain-coated cast iron tub that sits on four legs. In most instances, the built-in tub has three sides encased in or by the surrounding wall and has a bottom perimeter that is flush with the floor on the exposed side. And, it is the exposed side that is chosen for alteration with an insert to make entry and departure easier. This opening, cut into the exposed sidewall of the tub, extends for a predetermined length within the sidewall and from the top of the sidewall, extends to a predetermined distance above the bottom of the bathtub. These predetermined distances are generally the dimensions of the step saddle 12 of the insert 10.

More specifically, a template is used to outline the portion of the tub 40 sidewall to be removed for the insertion and placement of the insert 10. With the aid of the template, an outline is drawn on the sidewall of the tub, and the defined section is cut out and removed with the appropriate tools dictated by the composition of the tub. A pattern is then made of the cutout area of the tub. The pattern outline is then transferred to the return lips 19 on the insert 10 to mirror the cutout section of the tub, and the insert 10 is cut to fit.

The insert 10 with all of its components, is then positioned in the cutout of the tub and aligned in the void of the cutout. It is then removed to permit the support-housing 30 to be secured to the bathroom floor with sealant, metal fasteners, or whatever is appropriate in the given instance.

A bonding compound is then applied to the return lips 19 of the step-plate 11 and around the mating edges of the adjustable 20 and support 30 housings. The insert is then repositioned over the cutout opening with the underside of the step-plate 11 resting on edged of the cutout void. The adjustable housing 20 is then bonded to the support housing 30 with a suitable sealant; and, finally, the return lips 19, running the entire perimeter of the step saddle 12 are joined to the tub with a waterproof caulk or sealant to finish the placement of the insert 10. After allowing a short period of time for the sealants to crosslink and cure, the insert is ready for use.

While the foregoing is a complete and detailed description of the preferred embodiments of the disclosed insert, numerous variations and modifications may be employed to implement the all-important purpose of the disclosure without departing from the spirit of the invention; and, therefore, the elaboration provided herein should not be assumed to limit, in anyway, the scope of the invention which is fairly defined by the appended claims.

What is claimed is:

1. A method of modifying an existing bathtub to facilitate access to the interior of said bathtub, said method comprises: creating an opening by cutting through an external sidewall of the bathtub said opening extending for a predetermined length of said sidewall and from the top of said sidewall to a predetermined distance above the bottom of said bathtub, said opening being generally U-shaped;

positioning in said opening a generally U-shaped step-saddle having an elongated step-plate to cover the bottom edge of said opening, a pair of generally parallel end plates extending from the ends of said step-plate to cover the sides of said opening and a pair of generally rectangular housings attached to the bottom of said step-plate and extending to rest directly on the bathroom floor, thus supporting said insert.

2. A bathtub insert facilitating access to the interior of said tub, said insert comprising: a generally U-shaped step saddle having an elongated step-plate with a pair of generally parallel end plates extending upwardly from the ends of said step-plate; and first and second housings attached to the bottom of said step-plate for extending to the bathroom floor to distribute the weight of said step saddle said first accepting at least a portion of said second housing therein so as to provide for an adjustable support.

* * * * *